United States Patent [19]

Crouch et al.

[11] Patent Number: 4,492,837

[45] Date of Patent: Jan. 8, 1985

[54] GUIDE MEANS FOR THE MOVABLE CONTACT ROD OF A VACUUM INTERRUPTER

[75] Inventors: Donald W. Crouch, Newton Square; Joseph C. Sofianek, Broomall, both of Pa.

[73] Assignee: General Electric Company, New York, N.Y.

[21] Appl. No.: 477,554

[22] Filed: Mar. 21, 1983

[51] Int. Cl.[3] ..... H01H 33/66

[52] U.S. Cl. ..... 200/144 B; 200/83 D

[58] Field of Search ..... 200/144 B, 83 C, 83 D, 200/285; 308/DIG. 9, 4 R, 3 R; 384/300

[56] References Cited

U.S. PATENT DOCUMENTS

| | | | |
|---|---|---|---|
| 3,176,538 | 4/1965 | Hurlow | 138/129 X |
| 3,622,724 | 11/1971 | Sofianek | 200/144 B |
| 4,071,727 | 1/1978 | Crouch et al. | 200/144 B |
| 4,271,340 | 1/1981 | Griesen | 200/144 B |
| 4,431,885 | 2/1984 | Sakuma et al. | 200/144 B |

*Primary Examiner*—A. D. Pellinen
*Assistant Examiner*—Morris Ginsburg
*Attorney, Agent, or Firm*—Walter C. Bernkopf; Richard A. Menelly; William Freedman

[57] ABSTRACT

A vacuum interrupter comprises an end plate having a central opening through which a movable contact rod extends. A tubular metallic bellows surrounds the contact rod and includes a plurality of annular convolutions at its inner diameter. Guide structure fixed to the end plate lines its central opening and is located outside said convolutions. A sleeve of self-lubricating plastic material surrounds the contact rod and is fixed thereto. This sleeve is disposed within the guide structure and within the tubular bellows and fits closely within said convolutions so that the convolutions are capable of bearing against the sleeve to assist in guiding the rod.

9 Claims, 1 Drawing Figure

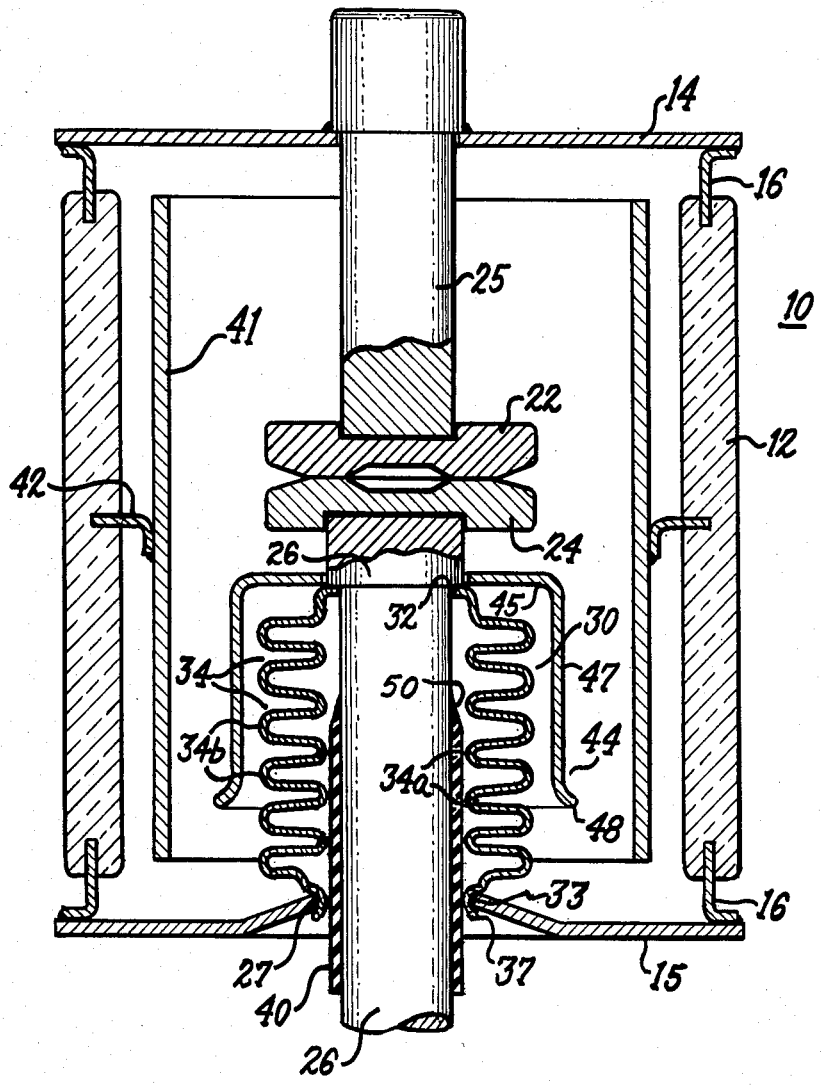
14
16
25
10
41
22
12
42
24
26
32
45
30
34
47
50
44
34b
34a
48
33
16
27
37
15
40
26

GUIDE MEANS FOR THE MOVABLE CONTACT ROD OF A VACUUM INTERRUPTER

BACKGROUND

This invention relates to a vacuum-type circuit interrupter and, more particularly, relates to guide means for the movable contact rod of such an interrupter.

The usual vacuum interrupter comprises an evacuated envelope including an end plate having a central opening, a contact rod extending through the central opening, and a tubular bellows surrounding the contact rod and having its inner end joined to the contact rod and its outer end joined to the end plate. For guiding the contact rod, it is customary to provide a tubular guide which is supported on the end plate and extends into the tubular bellows, as is illustrated, for example, in U.S. Pat. No. 4,071,727—Crouch et al.

While this type of guide is quite effective, it is subject to a number of disadvantages. One is that the tubular bellows must have a relatively large internal diameter in order to accommodate the tubular guide which is located therein. Another is that the guide is relatively expensive when it is considered that it must be suitably attached to the end plate in a precise position in order to perform its desired function.

SUMMARY

An object of our invention is to provide guide means for a vacuum interrupter that lends itself to use with a bellows of relatively small diameter and is simple and inexpensive.

In carrying out the invention in one form, we provide a vacuum interrupter comprising a cylindrical shell of insulating material and an end plate extending transversely of the shell and joined thereto in sealed relationship. The end plate has a central opening and a movable contact rod extends therethrough axially of the shell. A contact is joined to the rod at its inner end. A tubular metallic bellows surrounds the contact rod and has axially opposed inner and outer ends and inner and outer diameters. The bellows includes a plurality of annular convolutions located at its inner diameter and at spaced locations along its length. The bellows is joined at its inner end to the contact rod and at its outer end to the end plate. Guide structure fixed to the end plate lines its central opening and is located outside said convolutions of the bellows. A sleeve of a material having a high degree of lubricity surrounds the contact rod and is fixed thereto. This sleeve is disposed within the guide structure and within the tubular bellows and fits closely within said convolutions of the bellows so that the convolutions are capable of bearing against the sleeve to assist in guiding said rod:

BRIEF DESCRIPTION OF DRAWING

For a better understanding of the invention, reference may be had to the following detailed description taken in conjunction with the accompanying drawing, wherein:

The single FIGURE is a cross-sectional view through a vacuum-type circuit interrupter embodying one form of our invention.

DETAILED DESCRIPTION OF PREFERRED EMBODIMENT

Referring now to the drawing, there is shown a vacuum-type circuit interrupter comprising a highly evacuated envelope 10 comprising a tubular casing 12 of electrical insulation material and two metal end caps 14 and 15 joined to the casing at its opposite ends by suitable seals 16. Located within the envelope are two relatively movable contacts 22 and 24.

Contact 22 is a stationary contact carried by a stationary contact rod 25 that extends in sealed relationship through the upper end cap 14. Contact 24 is a movable contact carried by a movable contact rod 26 that extends freely through a central opening 27 in the lower end cap 15.

For providing a seal about the movable contact rod 26, a flexible metallic bellows 30, preferably of stainless steel, is provided. This bellows is of a generally tubular form and surrounds the movable contact rod 26. The bellows is of a conventional construction, comprising a thin metal wall of tubular configuration that contains a plurality of annular convolutions 34. The convolutions include inner convolutions **34*a*, which are disposed at the inner periphery of the bellows at spaced locations along the bellows length, and outer convolutions 34*b*, which are disposed at the outer periphery of the bellows at spaced locations along the bellows length. The upper end of the bellows is joined to the movable contact rod 26 by a brazed joint at 32, and the lower end of the bellows is joined to the lower end plate 15 by a brazed joint at 33. The brazed joint 33 is provided between an annular lip 37 on the lower end of the bellows and the annular portion of the end cap 15 surrounding its central opening 27. As will soon be further explained, the annular lip 37 constitutes a guide structure fixed to the lower end plate and lining the central opening 27. This guide structure 37, it is noted, is located in a position outside the inner convolutions 34*a*** of the bellows.

The guide structure 37 surrounds the movable contact rod 26 and cooperates with a sleeve 40 that is fixed to and closely surrounds the contact rod. The sleeve 40 is of a material that has a high degree of lubricity, such as polytetrafluoroethylene, referred to herein as TFE. Such material is available from E. I. DuPont Company under the trademark Teflon. The sleeve 40 is preferably formed and applied by slipping over the movable contact rod 26 a snugly-fitting tube of heat-shrinkable TFE and then heating the rod and the sleeve. This causes the sleeve to shrink tightly about the rod, thereby retaining the sleeve in its desired position on the rod.

The interrupter is shown in its closed position, i.e., with its contacts 22 and 24 engaged. Opening, or circuit interruption, is effected by driving the movable contact rod 26 downwardly, thereby separating the movable contact 24 from the stationary contact 22. Such contact-separation establishes an arc between the contacts, and the arc persists until approximately a natural current zero is reached, at which time it is prevented from reigniting, and circuit-interruption is accordingly completed.

For condensing the metallic vapors generated by the arc, a tubular metal shield 41 is provided. This shield surrounds the contacts 22 and 24 and is normally, electrically isolated from both contacts. The shield 41 is suitably supported on the insulating casing 12, as by means of a supporting ring 42.

For protecting the bellows against the above-described metallic vapors, a bellows shield 44 of inverted cup-shape is provided. This shield has a base 45 with a central opening that receives the movable contact rod 26 and is brazed thereto. The tubular portion 47 of shield 44 surrounds the bellows in radially spaced relation. When the interrupter is in its closed position shown, the lower end 48 of the bellows shield is spaced from the lower end plate 15. This lower end 48 serves as a stop for limiting the downward opening stroke of the movable contact rod 26. More specifically, the downward opening stroke of the contact rod is terminated by having the lower end 48 of the shield 44 strike the lower end plate 15.

As previously noted, the contact rod 26 is guided during its downward opening motion and its upward closing motion by the annular guide structure 37 that closely surrounds the sleeve 40. To assist with this guiding action, the sleeve 40 is extended into the tubular bellows 30 and is provided with an outer diameter of such size that it fits closely within the inner convolution **34*a* of the bellows. As a result, the sleeve 40 can bear on these inner convolutions 34*a* during vertical motion of the contact rod 26 if and when the rod deviates from its centrally disposed position within the bellows. The lower convolutions of the bellows can resist transverse displacement by the contact rod, and thus the bellows tends to maintain the contact rod in a central position with respect to the bellows and with respect to the end plate 15. The lubricity of the sleeve 40** allows the sleeve to slide in a vertical direction on the inner convolutions without damage to the bellows or its convolutions.

It is to be noted that effective guidance of the contact rod is performed without relying upon a separate stationary guide fixed to the lower end plate. Such a guide is usually in the form of a tube extending into the bellows and provided with a radially-extending flange bolted to the lower end plate, as shown in the aforesaid U.S. Pat. No. 4,071,727—Crouch et al. The tubular portion of such a guide requires space within the bellows, and the bellows must be made larger in diameter in order to accommodate this tubular member. Since we are able to dispense with such a tubular stationary guide, we obviate the need for enlarging the bellows to accommodate it, and we also eliminate the expense of such a guide and of any fastening means that would be needed to precisely attach the guide to the lower end plate.

It is highly desirable that the bellows have a relatively small diameter since this reduces its cost and also reduces the space within the evacuated envelope that is consumed by the bellows. This allows for a smaller and less expensive bellows shield (44) and provides larger clearances between spaced parts (44 and 41) for withstanding the voltages appearing between such parts.

To reduce the chances that the bellows will be damaged through contact between the upper end of sleeve 40 and the inner convolutions **34*a* during upward closing motion of movable contact rod 26, the sleeve 40 is gradually tapered at its upper end, as shown at 50. This removes any sharp corner at this location that could impinge against an inner convolution. We can avoid the need for such tapering if the sleeve is made very thin in wall thickness; but with greater thicknesses, the taper at 50 is desirable. We have used a wall thickness of 20 mils without a taper at 50** and with good results.

While we have shown a particular embodiment of our invention, it will be obvious to those skilled in the art that various changes and modifications may be made without departing from the invention in its broader aspects; and we, therefore, intend herein to cover all such changes and modifications as fall within the true spirit and scope of our invention.

What we claim as new is:

1. A vacuum type circuit interrupter comprising:

(a) an evacuated envelope comprising a cylindrical shell of electrical insulating material and an end plate extending transversely of said shell and joined thereto in sealed relationship, said end plate having a central opening therein, (b) a movable contact rod extending through said central opening generally axially of said shell, (c) a contact joined to said rod at the inner end of the rod, (d) a tubular metallic bellows surrounding said contact rod and having axially opposed inner and outer ends and inner and outer diameters, the bellows including a plurality of annular convolutions located at its inner diameter and at spaced locations along its length, (e) means for joining the inner end of the bellows in sealed relationship to said contact rod, and means for joining the outer end of the bellows in sealed relationship to said end plate, (f) guide structure lining said central opening, fixed to said end plate, and located outside said convolutions of said tubular bellows, (g) a sleeve of a material having a high degree of lubricity surrounding said contact rod and fixed thereto, said sleeve being disposed within said guide structure and within said tubular bellows, the sleeve fitting closely within said convolutions of the bellows so that the convolutions are capable of bearing against said sleeve to assist in guiding said rod, and (h) said guide structure closely surrounding said sleeve and cooperating therewith for guiding said rod.

2. The interrupter of claim 1 in which said sleeve is made from a tube of heat-shrinkable plastic material fitted about said contact rod.

3. The interrupter of claim 1 in which the sleeve fits closely within the convolutions of said bellows located adjacent said end plate so that said convolutions adjacent said end plate are capable of bearing against said sleeve to assist in guiding said rod.

4. The interrupter of claim 1 in which said sleeve has an inner end located within said bellows, said inner end having a tapered configuration.

5. The interrupter of claim 3 in which said sleeve has an inner end located within said bellows, said inner end having a tapered configuration.

6. The interrupter of claim 1 wherein said sleeve comprises a material having a high degree of lubricity and further having a high electrical resistivity.

7. A vacuum type circuit interrupter comprising:

(a) an evacuated envelope comprising a cylindrical shell of electrical insulating material and an end plate extending transversely of said shell and joined thereto in sealed relationship, said end plate having a central opening therein, (b) a movable contact rod extending through said central opening generally axially of said shell, (c) a contact joined to said rod at the inner end of the rod, (d) a tubular metallic bellows surrounding said contact rod and having axially opposed inner and outer ends and inner and outer diameters, the bellows including a plurality of annular convolutions located at its inner diameter and at spaced locations along its length, (e) means for joining the inner end of the bellows in sealed relationship to said contact rod, and means for joining the outer end of the bellows in sealed relationship to said end plate, (f) guide structure comprising the outer end of the tubular bellows lining said central opening, fixed to said end plate, and located outside said convolutions of said tubular bellows, (g) a sleeve of a material having a high degree of lubricity surrounding said contact rod and fixed thereto, said sleeve being disposed within said guide structure and within said tubular bellows, the sleeve fitting closely within said convolutions of the bellows so that said convolutions are capable of bearing against said sleeve, and (h) said guide structure closely surrounding said sleeve and cooperating therewith for guiding said rod.

8. The interrupter of claim 7 wherein the outer end of the bellows comprises an annular lip lining said central opening.

9. The interrupter of claim 7 wherein said sleeve comprises a material having a high degree of lubricity and further having a high electrical resistivity.

* * * * *